US006457580B1

(12) United States Patent
Focke et al.

(10) Patent No.: US 6,457,580 B1
(45) Date of Patent: Oct. 1, 2002

(54) HINGE LID PACK FOR CIGARETTES OR SUCH LIKE

(75) Inventors: Heinz Focke, Verden; Henry Buse, Visselhövede, both of (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 09/701,649

(22) PCT Filed: May 29, 1999

(86) PCT No.: PCT/EP99/03747

§ 371 (c)(1),
(2), (4) Date: Nov. 30, 2000

(87) PCT Pub. No.: WO99/65796

PCT Pub. Date: Dec. 23, 1999

(30) Foreign Application Priority Data

Jun. 17, 1998 (DE) ..... 198 26 621
Dec. 18, 1998 (DE) ..... 198 58 781

(51) Int. Cl.[7] ..... A24F 15/00
(52) U.S. Cl. ..... 206/259; 206/268; 206/273
(58) Field of Search ..... 206/259, 261, 206/265, 268, 271, 273

(56) References Cited

U.S. PATENT DOCUMENTS 885,374 A * 4/1908 Pohlig ..... 206/271
898,125 A * 9/1908 Marcuse ..... 206/271
D322,687 S * 12/1991 Tschudin ..... D27/183
5,097,948 A * 3/1992 Campbell ..... 206/268
D341,315 S * 11/1993 Seymour ..... D9/424
D355,275 S * 2/1995 Focke ..... D27/189
D356,183 S * 3/1995 Conti ..... D27/186
D393,924 S * 4/1998 Wright ..... D27/186
5,823,331 A * 10/1998 Manservigi et al. ..... 206/271

FOREIGN PATENT DOCUMENTS

| | | |
|---|---|---|
| EP | 204 933 | 12/1986 |
| EP | 434 962 | 7/1991 |
| EP | 507 112 | 10/1992 |
| EP | 778 212 | 12/1995 |
| GB | 642988 | 9/1950 |
| WO | 96 09230 | 3/1996 |

* cited by examiner

*Primary Examiner*—Shian Luong
(74) *Attorney, Agent, or Firm*—Sughrue Mion, PLLC

(57) ABSTRACT

Hinge-lid box for cigarettes or the like, comprising a box part (10) and lid (11) and a collar (35) which is positioned in the box part (10) and projects out of the same by way of a top collar part (39), the lid (11) enclosing the top collar part (39) in the closed position. Fastened on the inside of a lid front wall (17) is a lid inner tab (32) which, merely in the region of a (relatively long) side edge (50), has a recess (52) which ensures form-fitting interlocking with a ridge (42) in the region of a collar front wall (36) when the lid is closed.

6 Claims, 4 Drawing Sheets

35
38
39
40
70
71
68
34
44
20
66
67
68
32
33
17
19
36
12
37
60
69
14
67
66
68
44
10
11

20
70
43
15
65
44
67
68
35
21
17
36
12
16
68
19
33
69
34
14
67
44
65

HINGE LID PACK FOR CIGARETTES OR SUCH LIKE

BACKGROUND OF THE INVENTION

The invention relates to a hinge-lid box for cigarettes or the like, having a box part, a lid articulated on a box rear wall, and having a collar which is arranged in the box part and has a collar front wall and collar side walls, a collar region which projects out of the box part—a top collar part—being enclosed by the lid in the closed position.

Hinge-lid boxes are common throughout the world as a type of cigarette pack. The pack contents—a cigarette group—are enclosed by an inner blank made of paper or tin foil and form a cigarette block. The hinge-lid box itself consists of thin cardboard.

SUMMARY OF THE INVENTION

The object of the invention is further to develop the configuration of hinge-lid boxes so as to achieve improved handling with lower outlay in terms of materials.

In order to achieve this object, the hinge-lid box according to the invention is characterized by the following features:

a) a lid front wall is designed with an obliquely running, bottom closing edge, b) upright pack edges are rounded—round edges—or bevelled—oblique edges.

The configuration of the lid, namely in particular the lid front wall, which is bounded by an obliquely running closing edge, makes it easier to open the lid and, in particular, to remove the cigarettes by way of an enlarged removal region. The configuration of the hinge-lid box with round edges or oblique edges (octagonal pack) results in a reduction in the amount of material used since, by virtue of correspondingly dimensioned round edges or oblique edges, the hinge-lid box is better adapted, in the cross-sectional region, to the contour of the pack contents, namely to the cigarette block.

Further features of the invention concern the configuration of the closing edge of the lid and of a corresponding mating closing edge as the top boundary of a box front wall, to be precise in particular in the region of the transition to box side walls.

The invention also concerns a specifically designed and/or adapted closing aid for the lid in the closed position.

BRIEF DESCRIPTION OF THE DRAWINGS

Further details of the hinge-lid box and of the blanks for producing such hinge-lid boxes are explained in more detail hereinbelow with reference to exemplary embodiments illustrated in the drawings, in which.

Figure 2:
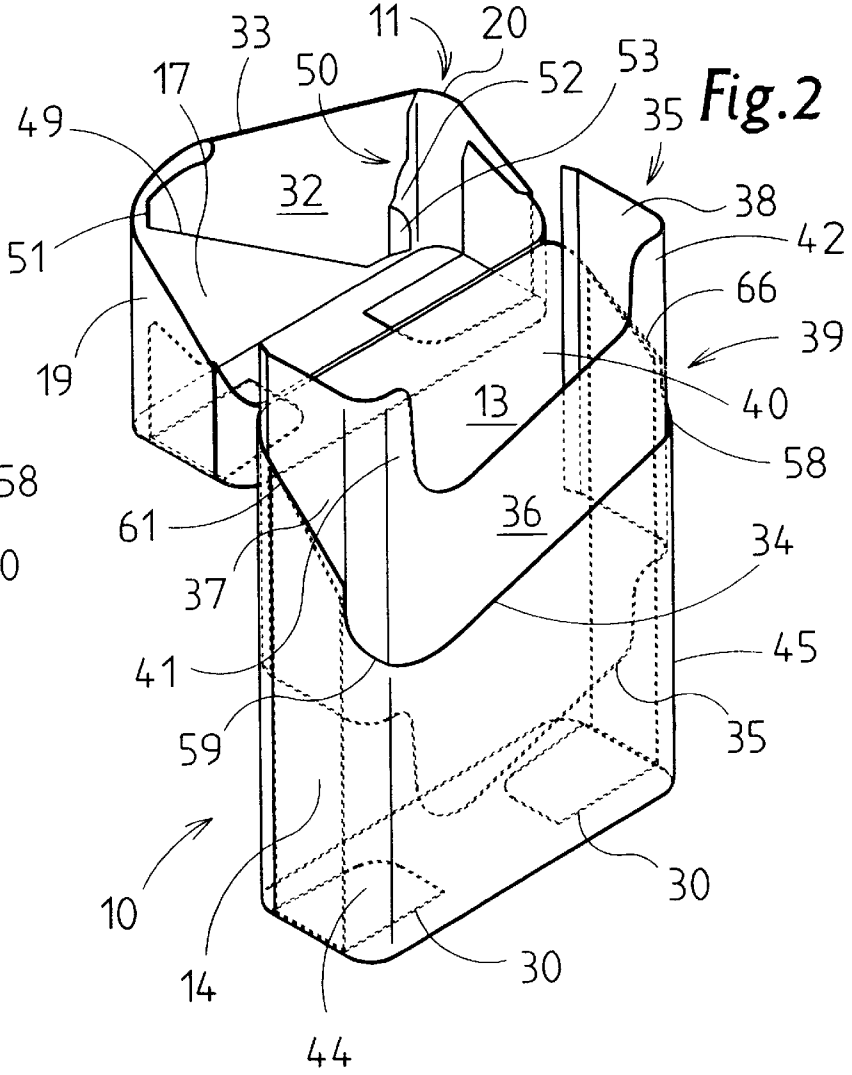
FIG. 2 shows the hinge-lid box according to FIG. 1 in the open position.

The hinge-lid boxes illustrated in the drawings comprise a (bottom) box part 10 and a (top) lid 11. The box part 10 has a box front wall 12, a box rear wall 13, located opposite said front wall, box side walls 14 and 15 and a base wall 16. Analogously to this, the lid 11 has a lid front wall 17, a lid rear wall 18, lid side walls 19, 20 and a top end wall 21.

The box side walls 14, 15 and lid side walls 19, 20 comprise inner and outer lid side tabs 22, 23; 24, 25 and correspondingly designed lid side tabs 26, 27; 28, 29. Corner tabs, namely base corner tabs 30 and lid corner tabs 31, are folded against the inside of the base wall 16 and of the end wall 21, respectively, and are connected thereto by adhesive bonding.

A lid inner tab 32 is arranged on the inside of the lid front wall 17. Said inner tab is connected integrally to the lid front wall 17 via a folding edge which, at the same time, forms a bottom closing edge 33 of the lid 11 in relation to the box part 10, namely in relation to the box front wall 12. The latter, in turn, is bounded at the top by a box edge or mating closing edge 34.

DETAILED DESCRIPTION OF THE INVENTION

The hinge-lid box also has a collar 35. The latter comprises a collar front wall 36 and collar side walls 37, 38. The collar 35 is positioned in the box part 10 —and connected to the same by adhesive bonding—such that a top collar part 39 projects out of the box part. Said top collar part is enclosed by the lid 11 in the closed position of the hinge-lid box.

Formed in the region of the collar front wall 36 is a collar recess 40 which is open in the upward direction and is bounded laterally, namely adjacent to the collar side walls 37, 38, by upright ridges 41, 42.

A special feature of the hinge-lid box is that the rectilinear closing edge 33 runs obliquely as a boundary of the lid front wall 17. The lid front wall 17 is thus of trapezoidal configuration.

Correspondingly, the mating closing edge 34 of the box part 10, said mating closing edge running parallel to the closing edge 33 of the lid 11, likewise runs obliquely. The arrangement is such that a spacing, namely a free gap 43, is formed between the closing edge 33 and the mating closing edge 34. The collar 35 can be seen in the region of said gap when the hinge-lid box is closed.

Figure 1:
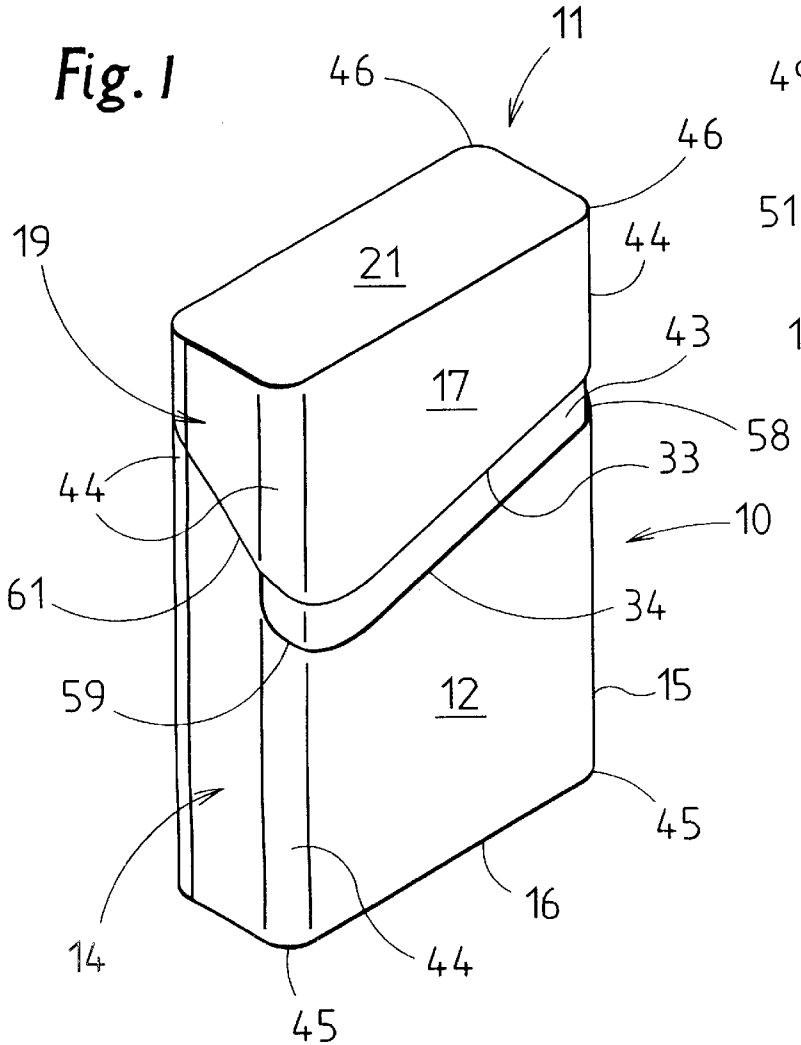
FIG. 1 shows a perspective illustration of the hinge-lid box with rounded pack edges in the closed position.

The hinge-lid box according to FIGS. 1 and 2 is designed as a round-edge pack. Upright pack edges 44 in the region of the box part 10, lid 11 and collar 35 are rounded. The rounded formation corresponds approximately to the dimensions of a cigarette. The base wall 16 and end wall 21 have a contour which is adapted to the rounded formations of the pack edges 44, that is to say they are provided with rounded formations 45, 46 in the region of the corners.

Figure 3:
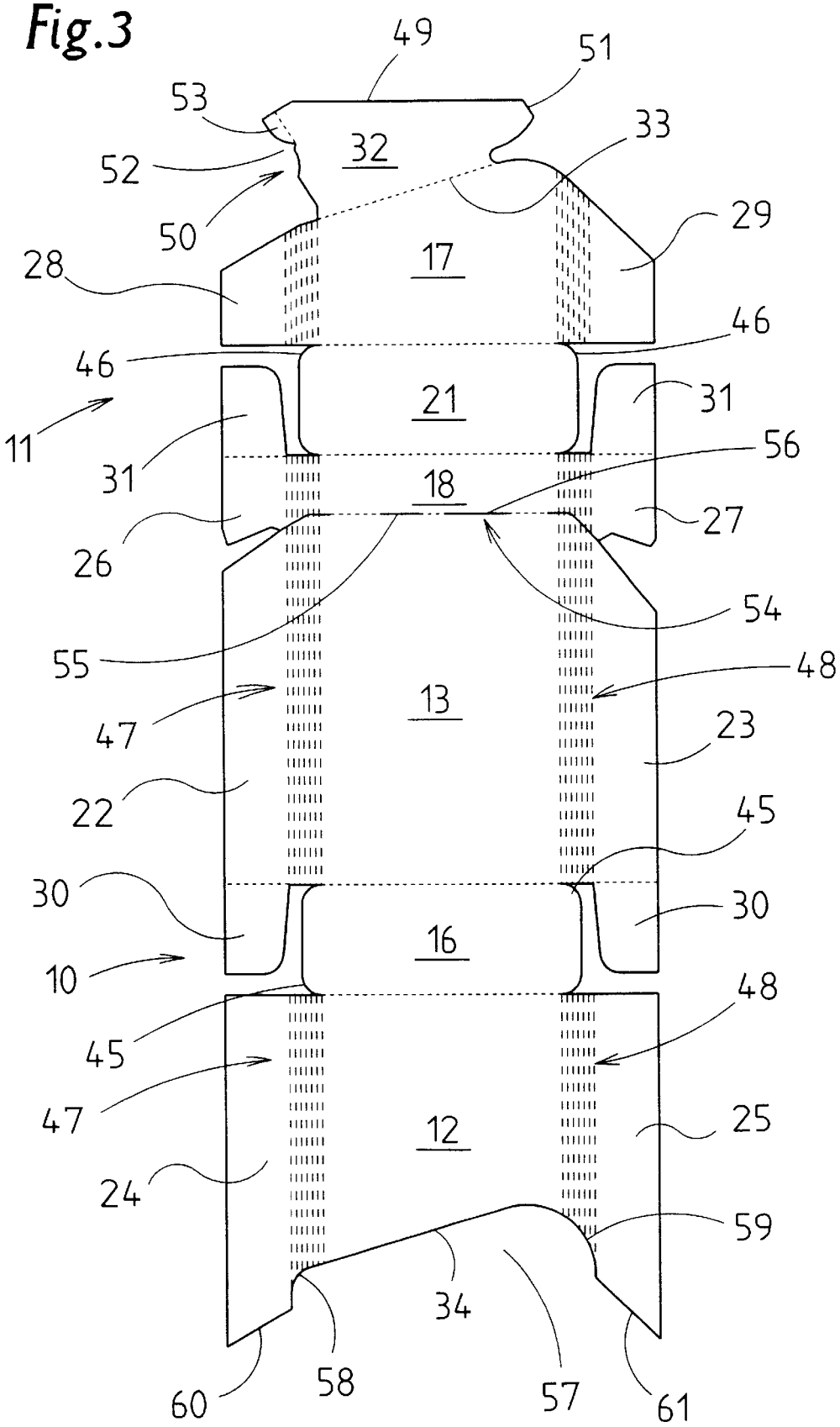
FIG. 3 shows a spread-out blank for a hinge-lid box according to FIGS. 1 and 2.

In order to form the round pack edges 44, the blank (FIG. 3) is pretreated correspondingly. Those regions of the blank which are to be rounded have material strips 47, 48 with parallel grooves which run in the longitudinal direction of the blank and are formed in the packaging material (thin cardboard) by stamping.

The lid inner tab 32 is of roughly trapezoidal contour. In this case, an outer edge 49 is directed precisely transversely to the longitudinal borders of the blank (FIG. 3), and thus also precisely transversely to the material strips 47, 48. This gives a comparatively long side edge 50 and, opposite this, a comparatively short side edge 51. In the region of the side edge 50, the lid inner tab 32 extends more or less over the entire height of the lid front wall 17. In the trapezoidal configuration of the lid front wall 17, said relatively long side edge 50 is located in the region of the relatively short dimension or height of the lid front wall 17. The side edge 50 is arranged such that, when the lid inner tab 32 is folded (FIG. 2), it runs more or less parallel to the pack edges 44.

A closing aid, that is to say a means for securing the closed position of the hinge-lid box (once the latter has been opened for the first time), is provided by the side edge 50. It is solely this side edge 50 which is provided with a laterally open recess 52 which, in the closed position of the lid 11, forms a form-fitting connection to the collar 35, to be precise to the associated ridge 42. The latter passes, by way of its top region facing towards the free border of the collar 35, into a position between the lid inner tab 32 and lid front wall 17, corresponding to the closing aid according to EP 434 962. In this case, the recess 52 is contoured so as to produce a projecting clamping tab 53 in the direction of the free side and/or on the side which faces towards the end wall 21. Said clamping tab can easily be raised off from the adjacent lid front wall 17 by corresponding material deformation, with the result that the ridge 42 of the collar 35 can be pushed into the position between the clamping tab 53 and lid front wall 17. The lid inner tab 32 is additionally connected to the lid front wall 17 by adhesive bonding such that the region adjacent to the side edge 50 is free for anchorage with the collar 35.

The stabilization of the closed position of the lid 11 is assisted by the configuration of a hinge line 54, by means of which the lid 11 is connected to the box part 10 in a pivotable manner in the region of the lid rear wall 18 and box rear wall 13. The hinge line 54 is configured such that reduced, material-induced restoring forces act on the lid 11 in the closed position of the same. For this purpose, the hinge line 54, which is actually designed as a folding line, is provided with punched sections 55, 56. A relatively short punched section 55 is formed on that side of the hinge-lid box on which the abovedescribed anchorage of the lid inner tab 32 with the collar 35 takes effect. A relatively long punched section 56 is formed on the opposite side of the pack.

A further special feature relates to the configuration of the hinge-lid box or of the blank in the region of the box front wall 12. The mating closing edge 34, as the top boundary of the box front wall 12, is set back in the downward direction, a recess 57 being formed in the process. At the ends, namely adjacent to the box side walls 14, 15, the mating closing edge 34 merges into a circle arc 58 and 59. The circle arcs 58, 59, which are arranged on opposite sides, are dimensioned differently, for example with a radius of 5 mm for the smaller circle arc 58 and with a radius of 14 mm for the larger circle arc 59.

The recess 57, which is bounded by the mating closing 35 edge 34 including the circle arcs 58, 59, extends to beyond the region of the material strips 47, 48. The entire width of the material strips 47, 48 terminates in the region of the recess 57. The circle arcs 58, 59 are adjoined in each case by an oblique edge 60, 61 as the closing edge in the region of the box side walls 14, 15. This not only gives the pack a pleasing configuration. The dimensioning of the recess 57 ensures an edge-free configuration of the round edges or pack edges 44 in this region.

The abovedescribed design principle for hinge-lid boxes can also be used in refinements with a bevelled pack edge 44, that is to say cross-sectionally octagonal hinge-lid boxes. An exemplary embodiment is shown by FIGS. 4 to 7. The pack edges 44 are formed by blank strips 65, 66 which are bounded by two parallel folding edges 67, 68. The blank strips 65, 66 run obliquely (45°) in the region between said folding edges 67, 68, to be precise with adaptation to the dimensions of the cigarettes.

With adaptation to this contour, the base wall 16 and end wall 21 are of octagonal design with oblique corners 62, 63, with adaptation to the cross-sectional shape of the hinge-lid box.

In the region of the front side, the box part 10 and lid 11 are configured analogously to the abovedescribed exemplary embodiment, that is to say with an obliquely running closing edge 33 for the lid front wall 17 and a mating closing edge 34, running parallel thereto, for the box front wall 12. The closing edge 33 and mating closing edge 34 are spaced apart from one another, with the result that an obliquely running gap 43 is produced. The collar front wall 36 can be seen in the region of said gap even when the hinge-lid box is closed (FIG. 4).

A further special feature resides in the configuration in the region of the front pack edges 44. The closing edge 33 and mating closing edge 34 extend merely in the region of the box front wall 12 and lid front wall 17, that is to say as far as the bevelled pack edges 44.

The two closing edges 33, 34 terminate with a rectilinear contour at the mutually facing folding edges 68 of the blank strips 65, 66. Following the mating closing edge 34, an upright edge leg 69, 70 extends upwards, in the region of the folding edges 68, as far as the oblique edge 60, 61. Accordingly, the latter extends rectilinearly in the region of the (outer) box side tabs 24, 25. The gap 43, which is bounded by the closing edges 33, 34, thus extends in an obliquely directed manner over the width of the box front wall 12 and lid front wall 17.

Figure 5:
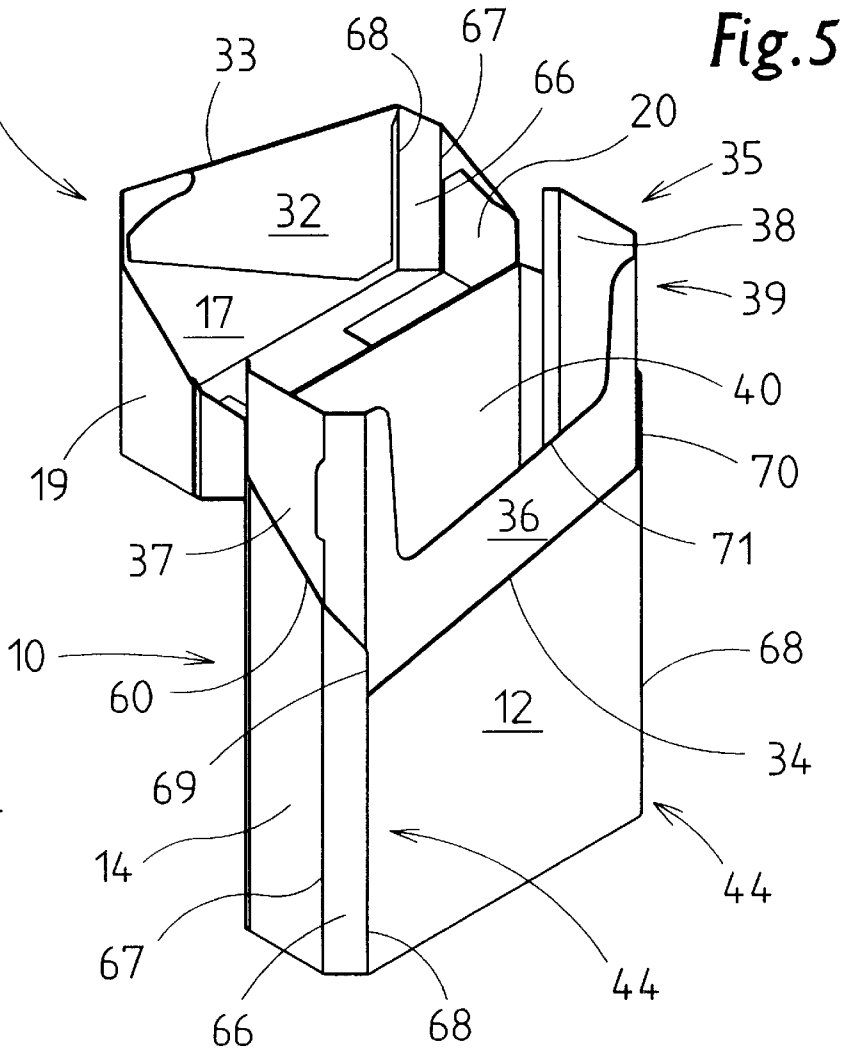
FIG. 5 shows a perspective illustration of the hinge-lid box according to FIG. 4 in the open position.
Figure 4:
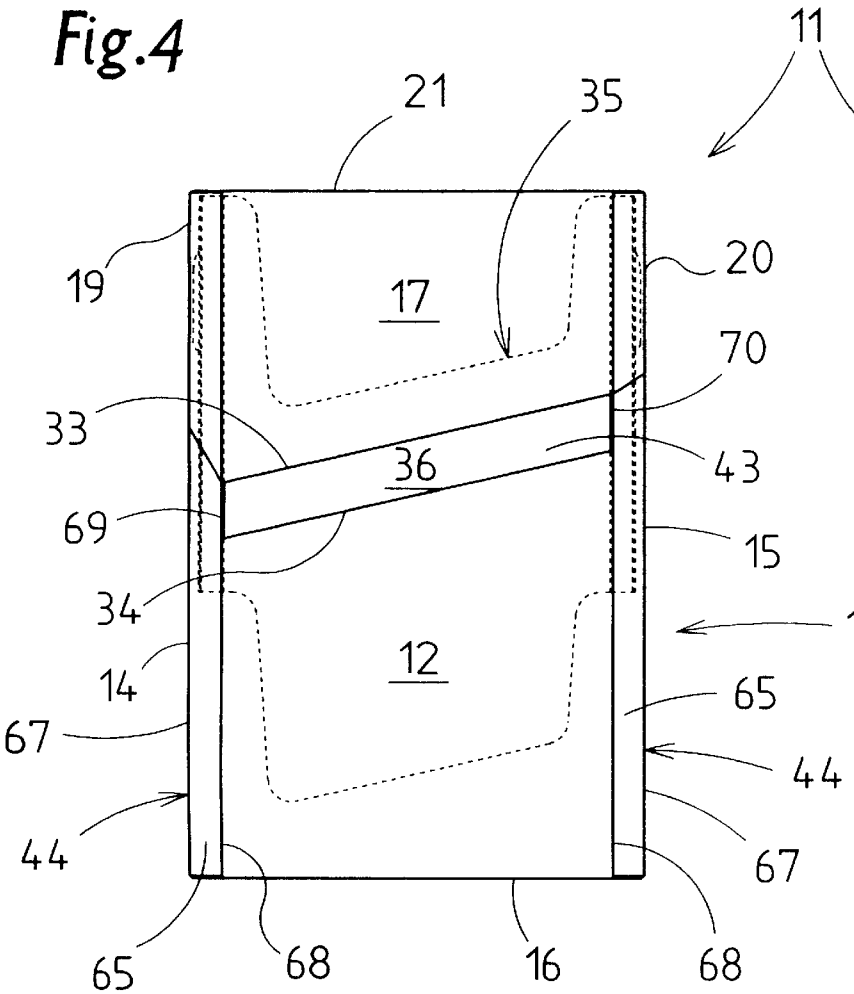
FIG. 4 shows a front view of another embodiment of a hinge-lid box.
Figure 6:
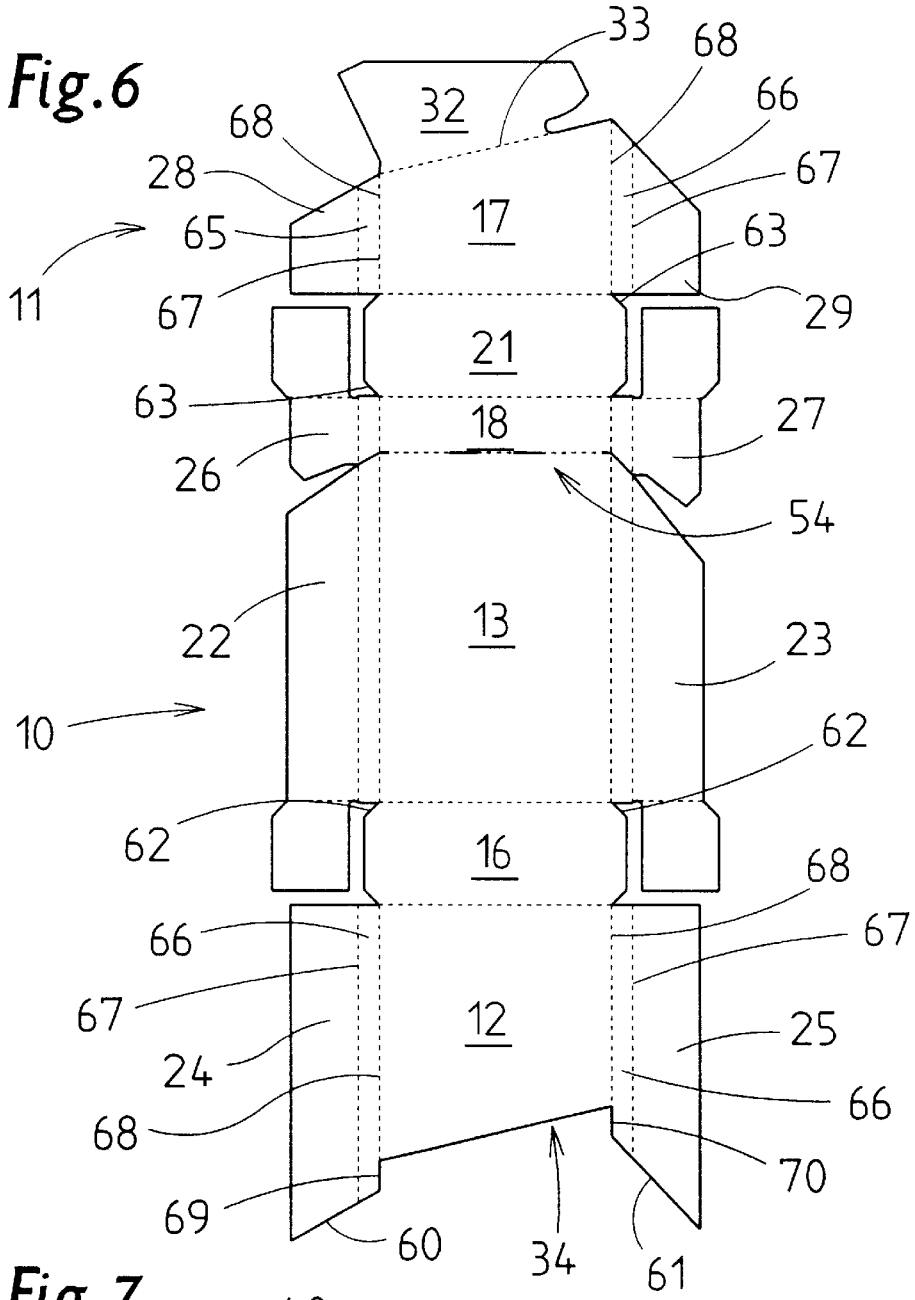
FIG. 6 shows a spread-out, non-folded blank for a hinge-lid box according to FIGS. 4 and 5.
Figure 7:
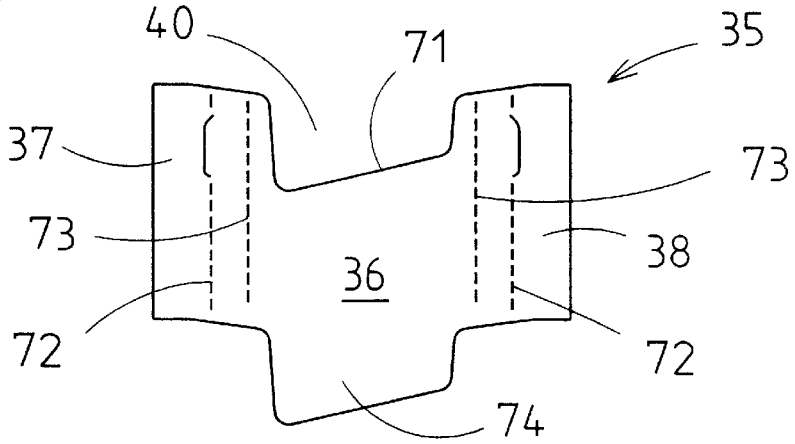
FIG. 7 shows a spread-out, non-folded collar for a hinge-lid box according to FIGS. 5 and 6.

The collar 35 (FIG. 7) is adapted to the configuration of the hinge-lid box according to FIGS. 4 to 6. The collar recess 40 is bounded in the region of the collar front wall by a collar edge 71 which runs obliquely, namely parallel to the closing edges 33, 34. The collar recess 40, which is bounded by the collar edge 71, is of trapezoidal design. In accordance with the configuration of the pack edges 44, the collar side walls 37, 38 are separated off from the collar front wall 36 by two parallel folding lines 72, 73, which each form a bevelled collar edge. A bottom collar extension 74 is adapted to the contour of the collar recess 40, with the result that the blanks of the collar 35 can be produced in a waste-free manner.

List of Designations

10 box part
11 lid
12 box front wall
13 box rear wall
14 box side wall
15 box side wall
16 base wall
17 lid front wall
18 lid rear wall
19 lid side wall
20 lid side wall
21 end wall
22 box side tab
23 box side tab
24 box side tab
25 box side tab
26 lid side tab
27 lid side tab
28 lid side tab
29 lid side tab
30 base corner tab

31 lid corner tab
32 lid inner tab
33 closing edge
34 mating closing edge
35 collar
36 collar front wall
37 collar side wall
38 collar side wall
39 top collar part
40 collar recess
41 ridge
42 ridge
43 gap
44 pack edge
45 rounded formation
46 rounded formation
47 material strip
48 material strip
49 outer edge
50 side edge
51 side edge
52 recess
53 clamping tab
54 hinge line
55 punched section
56 punched section
57 recess
58 circle arc
59 circle arc
60 oblique edge
61 oblique edge
62 oblique corner
63 oblique corner
64 round corner
65 blank strip
66 blank strip
67 folding edge
68 folding edge
69 edge leg
70 edge leg
71 collar edge
72 folding line
73 folding line
74 collar extension

What is claimed is:

1. A hinge-lid box for cigarettes, having a box part (10), having a lid (11) articulated on a box rear wall (13), and having a collar (35) which is arranged in the box part (10) and which has a collar front wall (36) and collar side walls (37, 38), characterized by the following features:

a) a lid front wall (17) with an obliquely running bottom closing edge (33), b) upright box edges (44) are curved, c) the collar front wall (36) of the collar (35) has ridges (41, 42) for bounding a collar recess (40) which is open in an upward direction, d) fastened on an inside of the lid front wall (17) is a lid inner tab (32) which, on a relatively long side edge (50), has an incision or a recess (52) into which, in the closed position of the lid (11), one of the ridges (41, 42) of the collar front wall (36) can be pushed such that a sub-surface of the one ridge (41, 42) passes into a region between the lid inner tab (32) and the lid front wall (17), e) the lid inner tab (32) is of trapezoidal design with the relatively long side edge (50) and a relatively short side edge (51), and f) the incision or a recess (52) is formed only on the relatively long side edge (50) and, in the closed position, interacts with the associated ridge (42) of the collar front wall (36), to make a form-fitting interlocking arrangement with the caller.

2. A hinge-lid box for cigarettes, having a box part (10), having a lid (11) articulated on a box rear wall (13), and having a collar (35) which is arranged in the box part (10) and which has a collar front wall (36) and collar side walls (37, 38), characterized by the following features:

a) a lid front wall (17) with an obliquely running bottom closing edge (33), b) upright box edges (44) are beveled, c) the collar front wall (36) of the collar (35) has ridges (41, 42) for bounding a collar recess (40) which is open in an upward direction, d) fastened on an inside of the lid front wall (17) is a lid inner tab (32) which, on a relatively long side edge (50), has an incision or a recess (52) into which, in the closed position of the lid (11), one of the ridges (41, 42) of the collar front wall (36) can be pushed such that a sub-surface of the one ridge (41, 42) passes into a region between the lid inner tab (32) and the lid front wall (17), e) the lid inner tab (32) is of trapezoidal design with the relatively long side edge (50) and a relatively short side edge (51), and f) the incision or a recess (52) is formed only on the relatively long side edge (50) and, in the closed position, interacts with the associated ridge (42) of the collar front wall (36), to make a form-fitting interlocking arrangement with the caller.

3. A hinge-lid box for cigarettes, having a box part (10), a lid (11) articulated on a box rear wall (13), and a collar (35) which is arranged in the box part (10) and which has a collar front wall (36) and collar side walls (37, 38), characterized by the following features:

a) a lid front wall (17) has an obliquely running bottom closing edge (33), b) a box front wall (12) forms an upper mating closing edge (34) running parallel to a closing edge (33) of the lid front wall (17), c) the mating closing edge (34) runs at a distance from the closing edge (33) in such a way that an exposed gap (43) is visible in a region of the collar front wall (36) when the hinge-lid box is closed, d) upright box edges (44) are curved to form round comers, e) the mating closing edge (34) has an arcuate configuration, in a region of lateral ends facing box side walls (14, 15), formed by circle arcs (58, 59) which adjoin the mating closing edge (34) in a transition-free manner, f) the circle arcs (58, 59) extend as end regions of the mating closing edge (34) into regions of corresponding ones of the box side walls (14, 15) in such a way that the gap (43), bordered by the closing edge (33) and mating closing edge (34), extends across a region of the rounded box edges (44), g) the collar front wall (36) of the collar (35) has ridges (41, 42) for bounding a collar recess (40) which is open in an upward direction, h) fastened on an inside of the lid front wall (17) is a lid inner tab (32) which, on a relatively long side edge (50), has an incision or a recess (52) into which, in the closed position of the lid (11), one of the ridges (41, 42) of the collar front wall (36) can be pushed such that a sub-surface of the one ridge (41, 42) passes into a region between the lid inner tab (32) and the lid front wall (17), i) the lid inner tab (32) is of trapezoidal design with the relatively long side edge (50) and a relatively short side edge (51), and j) the incision or a recess (52) is formed only on the relatively long side edge (50) and, in the closed position, interacts with the associated ridge (42) of the collar front wall (36), to make a form-fitting interlocking arrangement with the caller.

4. A hinge-lid box for cigarettes, having a box part (10), a lid (11) articulated on a box rear wall (13), and a collar (35) which is arranged in the box part (10) and which has a collar front wall (36) and collar side walls (37, 38), characterized by the following features:

a) a lid front wall (17) has an obliquely running bottom closing edge (33), b) a box front wall (12) forms an upper mating closing edge (34) running parallel to a closing edge (33) of the lid front wall (17), c) the mating closing edge (34) runs at a distance from the closing edge (33) in such a way that an exposed gap (43) is visible in a region of the collar front wall (36) when the hinge-lid box is closed, d) upright box edges (44) are beveled to form oblique edges (60, 61) with obliquely directed blank strips (65, 66) bordered by folding edges (67, 68), e) the closing edge (33) and the mating closing edge (34) extend only in a region of the box front wall (12) or lid front wall (17) up to the beveled box edges (44), and f) upright edge legs (69, 70) adjoin ends of the mating closing edge (34) in a region of the folding edges (68) to form end borders of the gap (43).

5. The hinge-lid box according to claim 4, characterized by the following features:

a) the collar front wall (36) of the collar (35) has ridges (41, 42) for bounding a collar recess (40) which is open in an upward direction, b) fastened on an inside of the lid front wall (17) is a lid inner tab (32) which, on a relatively long side edge (50), has an incision or a recess (52) into which, in the closed position of the lid (11), one of the ridges (41, 42) of the collar front wall (36) can be pushed such that a sub-surface of the one ridge (41, 42) passes into a region between the lid inner tab (32) and the lid front wall (17), c) the lid inner tab (32) is of trapezoidal design with the relatively long side edge (50) and a relatively short side edge (51), and d) the incision or a recess (52) is formed only on the relatively long side edge (50) and, in the closed position, interacts with the associated ridge (42) of the collar front wall (36), to make a form-fitting interlocking arrangement with the caller.

6. The hinge-lid box according to claim 3 or 5, characterized by the following features:

a) a hinge line (54) for the pivotable connection of the box part (10) and lid (11) has weakened material sections (55, 56) in order to reduce restoring forces of the material in the closed position of the lid (11), and b) formed, in a region of the relatively short side edge (51) of the lid inner tab (32), which side edge cannot be interlocked with the collar (35), is a relatively large weakened section of the hinge line (54), formed by a relatively long punched section (56), for additional reduction of restoring forces in this region.

* * * * *